United States Patent [19]

Zimmern

[11] Patent Number: 4,861,246

[45] Date of Patent: Aug. 29, 1989

[54] INJECTED COMPRESSOR WITH LIQUID SWITCH

[76] Inventor: Bernard Zimmern, 6 New St., East Norwalk, Conn. 06855

[21] Appl. No.: 141,969

[22] Filed: Jan. 7, 1988

[51] Int. Cl.[4] ..... F04C 29/02

[52] U.S. Cl. ..... 418/84; 418/100

[58] Field of Search ..... 418/84, 87, 97, 100

[56] References Cited

U.S. PATENT DOCUMENTS

| | | | |
|---|---|---|---|
| 1,675,524 | 7/1928 | Zajac . | |
| 2,204,757 | 6/1940 | Henze . | |
| 3,542,497 | 11/1970 | Chapuis | 418/84 |
| 3,820,350 | 6/1974 | Brandin et al. | 62/193 |
| 3,904,321 | 9/1975 | Ruedi et al. | 418/97 |

FOREIGN PATENT DOCUMENTS

| | | |
|---|---|---|
| 2164224 | 7/1973 | France . |
| 2541388 | 5/1987 | France . |
| 58-122390 | 7/1983 | Japan . |
| 2053360 | 2/1981 | United Kingdom . |

*Primary Examiner*—John J. Vrablik

*Attorney, Agent, or Firm*—Young & Thompson

[57] ABSTRACT

In a positive displacement compressor, first and second liquid injection holes are provided. The first hole is subjected substantially to the intake pressure. The other is subjected to a higher average pressure. A valve controls flow towards the first hole. When the discharge pressure is high, injection occurs through the second hole, the valve is closed. Under such operating conditions, the compressor has a good efficiency because the gas resulting from flashing of the injected liquid in the compressor needs only to be recompressed from said higher average pressure instead from said intake pressure, and does not take up space in the compressor which would limit the intake capacity of the compressor. If the discharge pressure decreases, the valve opens, allowing for injection through the first hole, thus eliminating the risks of seizure in the compressor if the injection liquid is at a pressure lower than the pressure in front of the second orifice, thus at a pressure insufficient for injection through the second orifice. The valve is a check-valve biased by a spring.

1 Claim, 1 Drawing Sheet

INJECTED COMPRESSOR WITH LIQUID SWITCH

This invention relates to a compressor in which liquid is injected, especially for cooling the compressor.

TECHNOLOGICAL BACKGROUND

Rotary compressors provided with liquid injections are known in the art. These compressors can be for instance of the vane type or of the single or twin-screw type.

The liquid injected into the compressor can be for instance oil, water or condensate of the gas in the case of regrigeration compressors.

This liquid is coming from a high pressure source, the pressure of which is generated by the compressor itself. Said source may be a tank in which oil is separated from the compressed gas, by gravity; or may be the condenser in the case of a refrigeration unit.

The liquid is basically used to cool the compressor; in some cases, the liquid is oil, and also lubricates and seals the compressor. The position of the injection hole (or holes, for instance in a single screw machine provided with two opposed compression chambers and therefore with at least two symetrical injection holes) is important for the efficiency.

If the hole is located in the compressor casing near the low pressure area thereof, the efficiency is reduced; indeed, the liquid carries a lot of gas, this being particularly true in the refrigeration systems in which the condensate, coming from the condenser, is injected substantially at intake pressure and flashes.

The flash gas may reduce the amount of gas sucked by the compressor, that is to say reduce the capacity of the compressor. Moreover, the flash gas has to be recompressed and thus reduces the efficiency.

It is therefore advantageous to move the location of the injection hole towards the high pressure area of the casing so as to reduce the amount of work to recompress the flash gas. Moreover, if the injection hole is far enough from the low pressure area, each compression chamber will communicate with the injection hole only when said chamber no longer communicates with the low pressure area, and the flash gas will not be able to affect the amount of gas sucked by the compressor.

However, in compressors which are used with variable compression ratios between intake and discharge, such as refrigeration compressors, it happens that, sometimes, due to the conditions in the refrigerating circuit, the discharge pressure becomes substantially equal to or lower than the average pressure at the injection hole; in such a case, the liquid injection flow is stopped; the compressor is no longer cooled, and may be subjected to seizure.

OBJECT OF THE INVENTION

A primary object of the invention is providing a positive displacement rotary machine having cheap means for injecting liquid while limiting lesser under high compression ratios and risks of injection failures under low compression ratios.

SUMMARY OF THE INVENTION

According to the invention, there is provided a positive displacement rotary compressor comprising a fixed casing with a low pressure intake and a high pressure discharge for gas to be compressed, at lesat one first and one second injection hole in the casing, an average pressure of the gas being compressed being lower in front of the first injection hole than in front of the second injection hole, each injection hole being connected to a high pressure source of liquid by respective tubes, wherein at least the tube connected to the first injection hole is equipped with a check valve adapted to stop the liquid flow when the difference between the average pressure in front of the first injection hole and the pressure in the high pressure discharge exceeds a preset value, said check valve having a valve member biased by a spring tending to open the valve, and said check-valve being oriented so that said check-valve closes when the pressure in the high pressure discharge increases with respect to the average pressure in front of the first injection hole. The first injection hole can be located in the casing so that the average pressure in front of the first hole be close to the intake pressure, or it can even be disposed in the compressor intake so that said first injection hole be permanently subjected to the intake pressure.

JP-A- 57 44 93 discloses opening an auxiliary valve at intake when the pressure difference of the pressure ratio between intake and discharge falls below a given value. But said opening or closing is achieved by using complicated electric or electronic equipment which introduces extra cost and extra risk of failure, whereas a check valve is simple, cheap and reliable.

BRIEF DESCRIPTION OF THE DRAWINGS

The invention will be better understood by reading the following description, with reference to the attached drawings given as a non-limiting example, and where.

DESCRIPTION OF A PREFERRED EMBODIMENT

Figure 1:
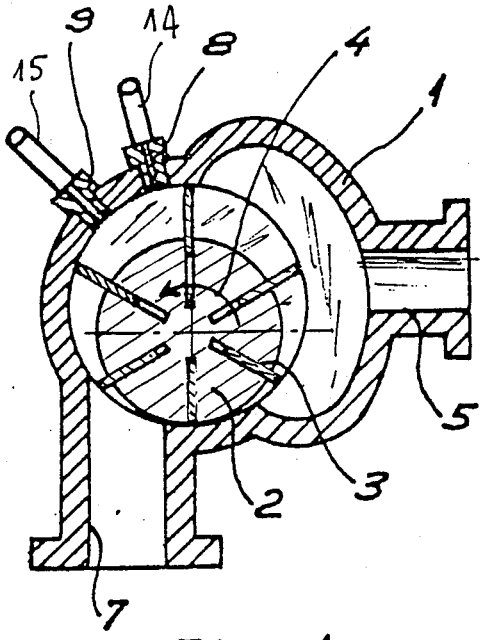
FIG. 1 is a cross section of a compressor according to the invention.

FIG. 1 shows the cross section of a positive rotary compressor of the vane type; but the invention could be embodied, without changes, with other positive displacement compressors such as twin screws compressors or single screw compressors.

The compressor is made of a casing 1 in which a rotor 2, carrying blades 3, rotates in the direction illustrated by arrow 4. The casing has a low pressure intake 5 through which gas to be compressed enters the compressor, and a high pressure discharge 7 through which compressed gas is delivered. The casing is also provided with two injection holes 8 and 9 through which a liquid can be injected.

These holes are set at different positions in the casing. The hole 8 is positioned in an area of the casing where the compression just starts, whereas the hole 9 is at a point where the average pressure in the casing, in front of the hole, is significantly higher than in front of the hole 8.

Figure 2:
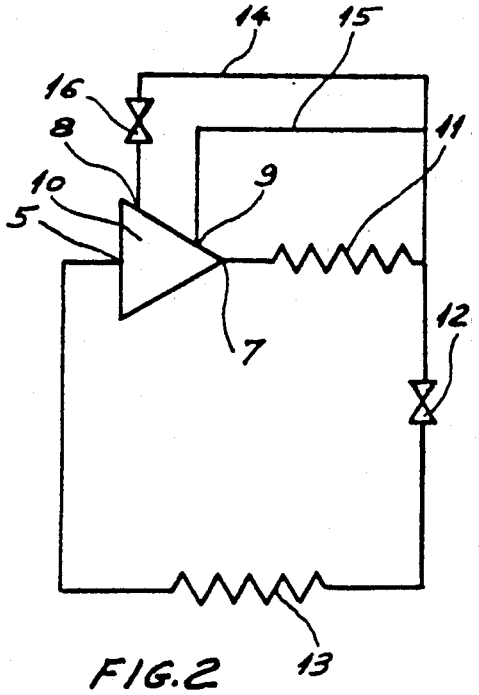
FIG. 2 is a diagrammatic view of a refrigeration circuit incorporating the compressor of FIG. 1.

The hole 8 could be set in the intake or the pipe leading the gas to the intake without changing the nature of the invention. FIG. 2 shows how a compressor according to the invention is built in a refrigerating system. The compressor of FIG. 1 is shown in 10; conveniently driven by a motor not shown, it delivers gas into a condenser 11 connected to an expansion valve 12 and an evaporator 13 from which the gas returns to the intake of the compressor 10.

Part of the condensate is taken from the downstream end of the condenser by tubes 14 and 15 respectively connected to the injection holes 8 and 9.

A valve 16, inserted in tube 14, comprises closing means to stop the liquid flow in the tube 14 when pressure between intake 6 and discharge 9 exceeds a preset value.

Figure 3:
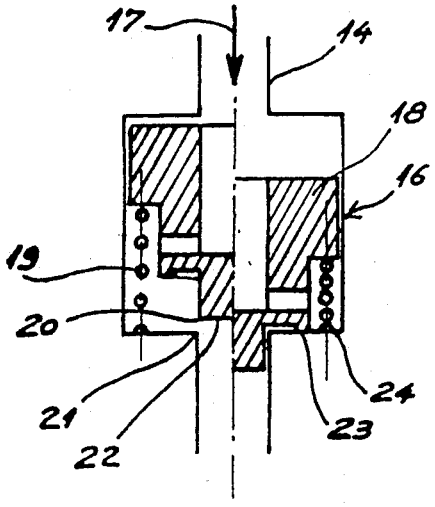
FIG. 3 is a cross section of a liquid valve of FIG. 2.

FIG. 3 shows a valve designed to achieve such purpose but clearly, many possible equivalent designs could achieve the same result.

FIG. 3 is a cross-sectional view of the valve, showing the valve in the open condition on the left hand side and in the closed condition on the right hand side.

The direction of the flow of liquid through the valve is shown by arrow 17.

A closing means or valve member 18 has a generally cylindrical shape and is movable axially.

A spring 19 maintains it normally open.

The cross-sectional area of the tube 14 is chosen so that the pressure of the liquid upstream of the valve is substantially equal to the pressure in the condenser 11 which itself is substantially equal to the discharge pressure in discharge 7.

Similarly the cross-sectional area of the tube downstream of the valve is chosen large enough so that the pressure adjacent the valve but downstream thereof is close to the average pressure in front of hole 8, substantially equal to intake pressure.

The pressure drop is therefore achieved in the passage between 20 and 21, controlled by valve member 18, so that the latter is subjected on its area 22 to a differential pressure dp 1 approximately equal to the difference between intake and discharge pressure and closes when the thrust created by such differential pressure exceeds the compression thrust of the spring.

This valve is therefore built as a check-valve which is maintained opened by the spring and which is oriented in the tube so as to close when the high pressure of the liquid increases with respect to the pressure in front of orifice 8.

When the closing means 18 closes, it rests by a ring 23 on face 24 of the envelope of the valve; said ring 23 extends along the outer periphery of an area which is broader than the area 22; thus, the spring 19 will open the valve only if the differential pressure dp 2 is lower than dp 1.

This feature prevents the valve from flapping when differential pressure reaches the opening or closing value.

Figure 4:
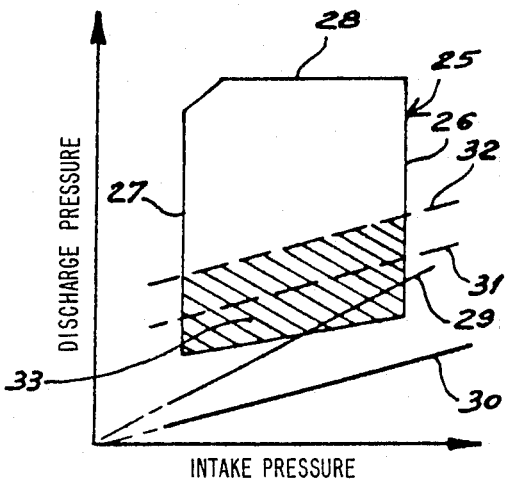
FIG. 4 is a diagram illustrating the operation of the invention under various pressure conditions.

FIG. 4 shows how such valve works on a diagram in which the abscissae represent intake pressure and ordinates, at a different scale, the discharge pressure.

Contour 25 shows the pressure limit conditions under which the compressor may operate, the actual operating conditions being thus inside said contour; typicallly in a refrigeration unit, used for instance for air conditioning, with refrigerant R22, the absolute intake pressure would be maximum 7 bars, minimum 1.5 bars, and the absolute discharge pressure would be 28 bars and so on, corresponding respectively to portions 26, 27, 28 of contour 25.

The average pressure of the gas being compressed in front of hole 9 is shown by line 29.

It is clear from such diagram that there is no possibility of injecting liquid into the compressor by hole 9 for any discharge pressure below line 29; successful injection even requires that the discharge pressure exceeds pressure of line 29 by some amount, for instance 1 or 2 bars.

Line 30 shows, inordinates, the average pressure of the gas in front of hole 8 as a function of intake pressure in abscissae; when hole 8 is made into intake, such average pressure is equal to intake pressure, and thus line 30 is the line along which the ordinates are equal to the abscissae, this line having a slope less than 45° due to the different scales along the abscissae and along the ordinates.

Line 31 shows the discharge pressure at which the valve 16 opens when the discharge pressure decreases (or intake pressure increases) and line 32 the discharge pressure at which valve 16 closes when discharge pressure increases (or intake pressure decreases).

Lines 31 and 32 are parallel to line 30. Indeed, for any intake pressure, the differential pressure between lines 30 and 31 is equal to the thrust of spring 19 divided by the surface area enclosed by ring 23 and the differential pressure between lines 32 and 30, approximately to the thrust of the spring divided by area of section 22 (there are some small differences, in practice, due to hydrodynamic pressure drops which result in the pressure on both ends of the valve not being exactly equal to discharge pressure and respectively to average pressure on the hole).

Valve 16 is set such that inside contour 25 line 31 is above line 29 by an amount that is equal to or larger than the minimum injection differential pressure deemed necessary through hole 9 for the safe operation of the compressor.

Now the compressor operates as follows:

when discharge pressure is above line 32, valve 16 is closed and injection occurs only through hole 9;

if discharge pressure is below line 31, valve 16 is open and injection occurs through hole 8;

if discharge pressure is between lines 31 and 32, valve 16 is open if compressor was coming from an operating point lower than 31 and closed if coming from an operating point higher than 32.

Hence, the valve 16 can be open only in conditions corresponding to hatched area 33 in FIG. 3.

It is therefore open only for lower discharge pressures and also lower compression ratios, the highest compression ratios being achieved in the left and upper corner of the contour 25.

Now it is well known that, the higher the average pressure is in front of an injection hole, the lower are the losses incurred by such injection.

Especially in refrigeration compressors, liquid injection whether oil injection or condensate injection, carries into the compressor a lot of gas which, if injected at intake, reduces the amount of useful gas sucked by the compressor and hence, it volumetric efficiency; even when injected in a compression chamber already separate from intake, the gas which flashes at injection has to be recompressed, needing extra work thereto; the closer the discharge pressure is to the pressure in the chamber in front of the injection hole, the less work is needed for recompressing the flash gas.

Therefore injection by hole 9 provides a much better efficiency than injection by hole 8.

As an example, a single screw compressor sweeping approximately 3000 liters/minutes of R22 with a compression ratio of 6 and injected with liquid refrigerant, can undergo a 10 percent improvement in efficiency when pressure in front of the injection hole is changed from 1.4 times intake pressure to 1.9 times.

The invention provides that possibility while ensuring that even at compression ratios close to 1.9 or even below, liquid injection will continue through hole 8, hence the compressor will be cooled and no seizure due to heating of the compressor by lack of coolant will occur.

It should be noted that although the operation with injection through hole 8 is less efficient, such operation occurs only for lower compression ratios where the advantages of hole 9 become much less (due to the lower compression ratio of the compressor, the extra work to recompress gas diminishes); thus, for the whole area 33, and in the previous example, the advantage of injection through-hole 9 instead of through-hole 8 would be only a few percent. Secondly, the discharge pressure being much lower, such loss occurs when the compressor consumes little power and therefore the overall compressor efficiency is neglibly influenced (for instance when measured as seasonal energy efficiency ratio SEER).

As a further improvement of the invention, it is possible to insert in tube 15 a check-valve which will prevent the direction of flow to reverse in tube 15 and the gas to flow from the compressor into the tube 15 and from there into the tube 14 when pressure at hole 9 becomes higher than discharge pressure; such flow would indeed reduce the amount of liquid injected by hole 8, reduce the cooling effect and increase the amount of gas to be recompressed.

Instead of a check-valve, it is also possible to mount a valve which, in a conventional way, is actuated by valve 16, closes when valve 16 opens and conversely.

I claim:

1. A positive displacement rotary compressor comprising a stationary casing provided with a low pressure intake port for gas to be compressed, a high pressure discharge port for compressed gas, at least one first and one second injection hole through the casing, an average pressure of the gas being compressed being lower in front of the first injection hole than in front of the second injection hole, each injection hole being connected by respective tubes to a high pressure source of liquid connected to the high pressure discharge port for pressurization of said liquid, wherein at least a said tube connected to the first injection hole is equipped with a check valve adapted to stop the liquid flow when the difference between the average pressure in front of the first injection hole and the pressure in the high pressure discharge exceeds a preset value, said check valve having a valve member biased by a spring tending to open the valve, and said valve member having a first face exposed to the pressure of the liquid from the source of liquid with said pressure of liquid tending to close the check valve, and a second face exposed to said pressure in front of the first injection hole, with said pressure in front of the first injection hole tending to open the valve.

* * * * *